US011815036B2

(12) United States Patent
Khosravi

(10) Patent No.: US 11,815,036 B2
(45) Date of Patent: Nov. 14, 2023

(54) COMPRESSED GAS TANK ARRANGEMENT FOR A COMBUSTION MACHINE

(71) Applicant: FORD GLOBAL TECHNOLOGIES, LLC, Dearborn, MI (US)

(72) Inventor: Maziar Khosravi, Cologne (DE)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 17/583,626

(22) Filed: Jan. 25, 2022

(65) Prior Publication Data

US 2022/0243673 A1 Aug. 4, 2022

(30) Foreign Application Priority Data

Feb. 4, 2021 (DE) ..... 102021102553.2

(51) Int. Cl.
*F02D 19/02* (2006.01)
*F02D 19/12* (2006.01)

(52) U.S. Cl.
CPC ..... *F02D 19/023* (2013.01); *F02D 19/022* (2013.01); *F02D 19/12* (2013.01); *F02D 2200/0602* (2013.01); *F02D 2250/31* (2013.01)

(58) Field of Classification Search
CPC ..... F02D 19/02; F02D 19/022; F02D 19/023; F02D 19/12; F02D 2200/06; F02D 2200/0602; F02D 2250/31
See application file for complete search history.

(56) References Cited

U.S. PATENT DOCUMENTS 5,454,408 A 10/1995 Dibella et al.
5,524,582 A * 6/1996 Suh ..... F02D 19/0615 123/576

(Continued)

FOREIGN PATENT DOCUMENTS

DE 102015016327 A1 6/2017
DE 102017204746 A1 9/2018

(Continued)

OTHER PUBLICATIONS

JP2021152357 English Translation Version.*
Examination Report DE 10 2021 102 553.2 Filed Oct. 4, 2021, 4 pages.

*Primary Examiner* — John Kwon
*Assistant Examiner* — Johnny H Hoang
(74) *Attorney, Agent, or Firm* — BROOKS KUSHMAN PC; David Kelley

(57) ABSTRACT

A vehicle, system, and method include a first tank configured to contain compressed gaseous fuel, such as hydrogen, and a second tank fluidly couplable to the first tank and an internal combustion engine, the second tank configured to store the gaseous fuel from the first tank in a communal cavity with a non-combustible liquid, such as water, without a bladder or physical separation barrier therebetween, and to selectively deliver the gaseous fuel via a first outlet, and the non-combustible liquid via a second outlet, to the internal combustion engine. A turbine may be disposed between the first and second tanks. One or more condensers may condense water from engine exhaust and/or an air conditioning system and pump the liquid water into the second tank. Pressure within the second tank may be controlled via fuel supplied by the first tank and/or liquid supplied via the condensers and pump.

18 Claims, 3 Drawing Sheets

(56) References Cited

U.S. PATENT DOCUMENTS

| | | | | |
|---|---|---|---|---|
| 5,797,583 | A * | 8/1998 | Murata | F16K 31/124 60/415 |
| 6,318,306 | B1 * | 11/2001 | Komatsu | F02B 43/08 123/3 |
| 9,328,659 | B2 * | 5/2016 | Jin | F01D 13/00 |
| 2002/0108865 | A1 * | 8/2002 | Bryan | C25B 1/26 205/556 |
| 2008/0087017 | A1 * | 4/2008 | Van Nimwegen | F02M 37/0082 60/599 |
| 2015/0322879 | A1 * | 11/2015 | Zeng | F02D 41/3094 701/103 |
| 2016/0290289 | A1 * | 10/2016 | Hashimoto | C10L 1/06 |
| 2017/0067425 | A1 * | 3/2017 | Abd Elhamid | F02B 43/00 |
| 2018/0023466 | A1 * | 1/2018 | Kim | F02M 25/12 123/3 |
| 2018/0230915 | A1 * | 8/2018 | Hehle | F02D 19/0671 |
| 2020/0052314 | A1 * | 2/2020 | Neubauer | H01M 8/0675 |
| 2021/0404427 | A1 * | 12/2021 | Wloka | F02M 37/0064 |

FOREIGN PATENT DOCUMENTS

| | | | | |
|---|---|---|---|---|
| JP | 2021152357 | A * | 9/2021 | F02M 21/02 |
| WO | 2008074075 | A1 | 6/2008 | |
| WO | 2018144328 | A1 | 8/2018 | |

* cited by examiner

COMPRESSED GAS TANK ARRANGEMENT FOR A COMBUSTION MACHINE

CROSS-REFERENCE TO RELATED APPLICATIONS

This application claims foreign priority benefits under 35 U.S.C. § 119(a)-(d) to DE 10 2021 102 553.2 filed Feb. 4, 2021, which is hereby incorporated by reference in its entirety.

TECHNICAL FIELD

This disclosure relates to a compressed gas tank arrangement for a combustion machine, such as an internal combustion engine for a motor vehicle.

BACKGROUND

To store gaseous fuel, usually comparatively large storage tanks are required which are filled at high pressure to achieve the necessary storage energy density. In the case of hydrogen-air combustion, the reaction products of the combustion are water or water vapor and nitrogen. The condensed vapor may be stored and provided as coolant. For this, an additional tank is required.

In connection with fuel stations for liquid fuel, usually pressure tanks are used which are designed for a constant storage pressure, wherein during a phase in which fuel is dispensed, the pressure is held constant by a liquid being conveyed from a liquid store to the respective pressure tank. Examples of this are disclosed in the documents DE 10 2017 204 746 A1, DE 10 2015 016 327 A1 and U.S. Pat. No. 5,454,408 A, for example.

In connection with gaseous fuel tanks arranged in a vehicle for operating an internal combustion engine, it is advantageous if the tanks take up as little storage space as possible and can be operated using substantially constant pressure to avoid pressure fluctuations that may stress the tanks.

SUMMARY

One or more configurations according to the disclosure provide an advantageous compressed gas tank arrangement for a combustion machine, such as an internal combustion engine for a motor vehicle, and a method for operating such a compressed gas tank arrangement. A method for operating a gas tank arrangement, an engine arrangement having a gaseous fuel tank, and a vehicle having a gaseous fuel tank providing various advantages are also described.

The gaseous fuel tank arrangement for a combustion machine comprises at least one first tank and a second tank fluidly connected thereto. The first tank and the second tank are designed for storing gaseous fuel, such as hydrogen, for example. The second tank is designed to be filled with a gaseous fuel, e.g. hydrogen, from the at least one first tank and to deliver the gaseous fuel to a combustion machine. For the supply of gaseous fuel to the first tank, the first tank may comprise a gas inlet valve. For the delivery of gas to a combustion machine, the second tank may comprise a gas outlet valve. The second tank is furthermore designed to be filled at least partially with an incombustible liquid, e.g. water, and to deliver the liquid to the combustion machine. In one configuration, the gaseous fuel and the incombustible liquid are stored within the same volume or the same cavity inside the second tank without any physical separation barrier. The gaseous fuel and the incombustible liquid thus come into direct contact with one another.

A gaseous fuel tank arrangement according to the disclosure may provide various advantages. For example, common storage of gaseous fuel and liquid, which may be condensation water occurring during operation of the combustion machine or another device, allows compensation of pressure losses as the gaseous fuel is consumed by the combustion machine by filling the second tank with water. At the same time, condensation water from combustion may be stored in a compact fashion and efficiently pressurized by the gas present in the second tank. After condensing, the water is thus available for injection into the combustion machine to mitigate combustion knock.

By directing water into the second tank, the volume available for the gas present in the second tank is reduced and the pressure in the second tank is increased. In a typical gas tank system, the pressure falls during consumption of the gas following the ideal gas law (p*V=2) m*R*T, with P=pressure, V=volume, m=mass, T=temperature, R=specific gas constant). In contrast, in the context of systems and methods according to this disclosure, particularly with the use of hydrogen gas, the water occurring during combustion can be returned to the tank so it is possible to keep the tank at a desired pressure level in an efficient fashion. The liquid water collects at the base of the tank. Thus, it is possible to extract the gaseous fuel from the top of the tank and extract the stored water from the bottom of the tank. The solution according to the claimed subject matter is suitable for any liquid and any gas in combination with one another, as long as the corresponding gas has a low solubility in the corresponding liquid.

As already stated, one advantage of the proposed solution is that the pressure in the tank does not reduce when gas is extracted therefrom. A further advantage is that the liquid, in particular the water, is stored in the same volume as the gas without a physical separation barrier and, accordingly, the necessary total storage volume is reduced. With respect to tanks having a physical barrier or bladder separating the gas and liquid, configurations according to this disclosure provide increased flexibility to accommodate large variations in the quantities/volumes apportioned to the gas and liquid within the tank. A further advantage is that, in comparison with conventional gas tanks, the walls of the tank need withstand a lower pressure gradient since the pressure in the tank can be kept constant within a specific pressure range.

Usually, conventional gas tanks must withstand a pressure of 300 bar in the interior and 1 bar ambient pressure, i.e. a ratio of 300:1, when completely filled; or, when half empty, a pressure ratio of 150:1; and when emptied further, a correspondingly lower ratio, for example 50:1, etc. In this way, the load and stress on the walls during use are significantly increased, and correspondingly thicker walls or a correspondingly stronger material are required. In the context of the present disclosure, the tank pressure may be kept almost constant, so the second tank need only be designed for a constant pressure gradient and the stress resulting from the pressure gradient bears evenly on the walls at all times.

In an advantageous variant, the first tank is designed for a maximum internal pressure between 350 bar and 750 bar. In addition or alternatively, the second tank may be designed for a maximum internal pressure between 30 bar and 350 bar. Furthermore, the second tank may be designed to deliver gas with a pressure between 7 bar and 30 bar (operating pressure) to a combustion machine. This has the advantage that the gas tank arrangement is suitable for an internal combustion engine operated with gaseous fuel, for example hydrogen.

In one configuration, the second tank has a gas inlet with a gas inlet valve, a gas outlet with a gas outlet valve, a liquid inlet with a liquid inlet valve, and a liquid outlet with a liquid outlet valve.

In another configuration, the second tank may be connected to a liquid storage device and/or a liquid return device and/or a liquid pump. Here, the second tank may for example be connected to an exhaust gas line of a combustion machine, such as an internal combustion engine. In addition, the second tank may be connected to further devices in which condensation water occurs during operation, for example an air conditioning system. In this way, the condensation water collecting during operation of the various devices may firstly be stored and secondly reused efficiently.

Furthermore, a turbine may be fluidly coupled between the first tank and the second tank. Thus, energy can be obtained from the pressure difference between the first tank and the second tank. For example, the pressure in the first tank may be 750 bar and the pressure in the second tank 30 bar. Accordingly, the turbine may make an energetically efficient use of this state.

A method according to the disclosure for operating a gas tank arrangement as previously described, a gaseous fuel, e.g. hydrogen, is supplied to the first tank with a pressure of more than 15 bar, e.g. a pressure between 350 bar and 750 bar. In other words, the first tank is filled with gaseous fuel at high pressure. Furthermore, gaseous fuel with a pressure of at least 10 bar, e.g. a pressure between 30 bar and 350 bar, is supplied to the second tank by means of the first tank. In other words, the second tank is filled by means of the first tank to an intermediate pressure, for example via a corresponding flow channel, using in particular a corresponding valve. Then gaseous fuel is supplied from the second tank to a combustion machine, for example an internal combustion engine, for its operation at an operating pressure within an established pressure range. Liquid, e.g. water, for example from condensation, which is recovered at least partially during operation of the combustion machine operated with hydrogen, for example, is routed to the second tank by means of a valve and/or a pump. The liquid is supplied to the combustion machine from the second tank. Here, the liquid may be pressurized by means of the gaseous fuel present in the second tank. In this way, the desired injection pressure for supply can be provided without additional measures, such as pumps or compressors.

Representative methods according to the disclosure may have the features and advantages already described above in connection with the gas tank arrangement. In various configurations, the gaseous fuel is hydrogen and the liquid is an incombustible liquid, such as water. During filling of the second tank, a turbine fluidly coupled between the first tank and the second tank may be driven, for example for obtaining energy. The operating pressure or injection pressure for injecting the gaseous fuel into the combustion machine may lie for example between 10 bar and 30 bar. The liquid, which may be water, may firstly be recovered during operation of the combustion machine, or may be obtained during operation of another device which is also operated in connection with operation of the combustion machine, for example during operation of a cooling device or air conditioning system.

If the pressure in the second tank lies below an established limit value or threshold, liquid may be pumped into the second tank until a desired pressure is reached. In this way, a substantially constant operating pressure can be maintained in the second tank and hence the load on the tank walls reduced. Liquid, for example water, may here be pumped from a corresponding liquid store into the second tank by means of a pump.

An engine arrangement according to the disclosure may include an internal combustion engine designed to be operated with a gaseous fuel, for example hydrogen. The engine arrangement comprises an above-described gas tank arrangement. Additionally or alternatively, the engine arrangement is designed to be operated in a method as described herein. An engine arrangement according to the disclosure may have the above-described features and advantages. In particular, an engine arrangement according to the disclosure may be coupled or connected to an air conditioning system, and condensation water occurring during operation of the air conditioning system may be returned to the second tank.

A vehicle according to the disclosure may include an engine arrangement as described herein. The vehicle may be a motor vehicle, such as a ship, a car, a truck, a bus, a motorcycle, a moped, etc.

In connection with combustion machines operated by means of gaseous fuel, in particular hydrogen, for example hydrogen internal combustion engines, configurations according to the disclosure may have the further advantage that water can be supplied to the combustion process in an efficient fashion to reduce or eliminate combustion knock in a simple manner. Hydrogen is substantially more susceptible to knocking during combustion in comparison with internal combustion engines operated with petrol or other fuels. As such, solutions which reduce the occurrence of engine knocking are necessary and can be achieved very efficiently in the context of various configurations described in this disclosure because the water to be injected into the combustion chamber to this end is obtained from condensation water. Furthermore, no additional water tank is necessary, since—as already described—the water is stored in the same tank as the gaseous fuel.

Representative examples of the claimed subject matter are explained in more detail below with reference to the associated figures. Although the claimed subject matter is illustrated and described in detail by means of the representative configurations, the claimed subject matter is not restricted to the examples disclosed and other variations may be derived therefrom by the person skilled in the art without leaving the scope of the claimed subject matter.

The figures are not necessarily true to detail or scale, and may be shown enlarged or reduced in order to offer a better overview. Therefore, the functional details disclosed here should not be interpreted restrictively but understood purely as an illustrative basis which offers the person skilled in this art a guide for implementing the claimed subject matter.

The term "and/or" used herein, when used in a series of two or more elements, means that each of the listed elements may be used alone, or any combination of two or more of the listed elements may be used. If, for example, a composition is described as containing the components A, B and/or C, the composition may contain A alone; B alone; C alone; A and B in combination; A and C in combination; B and C in combination; or A, B and C in combination.

DETAILED DESCRIPTION

As required, detailed embodiments of the claimed subject matter are disclosed herein; however, it is to be understood that the disclosed embodiments are merely representative and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the claimed subject matter.

Figure 1:
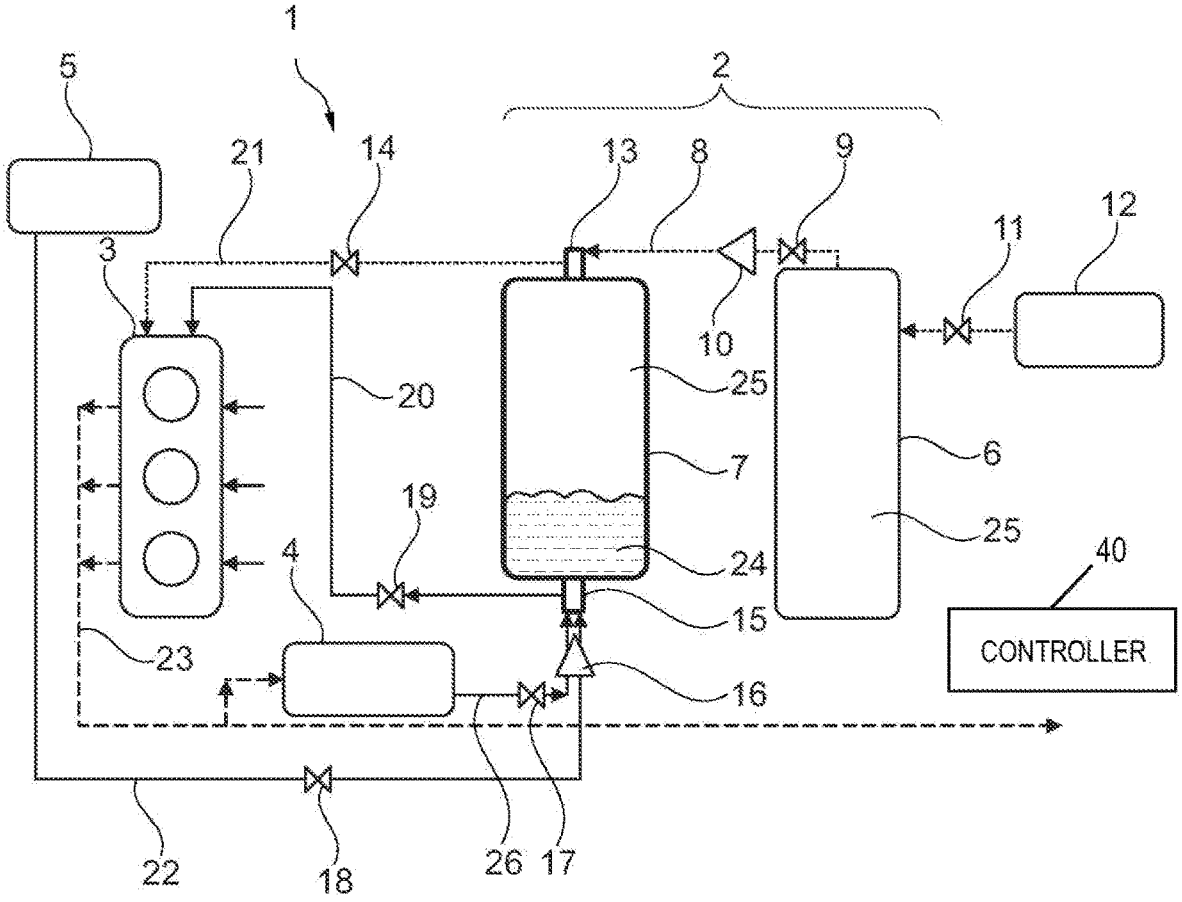
FIG. 1 shows schematically a representative engine arrangement according to the disclosure.

FIG. 1 shows schematically an engine arrangement 1 according to a representative configuration of the claimed subject matter. The engine arrangement 1 comprises a gas tank arrangement 2, an internal combustion engine 3, a condenser 4, and optionally an air conditioning condenser 5 connected to an air conditioning system (not shown). The gas tank arrangement 2 comprises a first tank 6 and a second tank 7.

The first tank has a gas inlet with an inlet valve 11 connected to a filler connector 12. In addition, the first tank 6 has a gas outlet which is fluidly connected via a flow channel 8 to a gas inlet 13 of the second tank 7. The first tank 6 and/or the flow channel 8 comprises a valve 9 and is fluidly connected to a gas turbine 10 for obtaining energy. The first tank 6 is configured for storing a gas 25, such as hydrogen, with a maximum pressure of between 350 bar and 750 bar.

The second tank 7 comprises a gas inlet 13 and a gas outlet 13 for routing gas into the tank and delivering gas from the tank. The gas inlet or gas outlet 13 is shown as one element in FIG. 1. It may however also be two elements which are configured and arranged separately from one another. The gas inlet and/or the gas outlet 13 is arranged in a vertically upper region of the second tank 7. The second tank 7 is designed to store a gas, for example hydrogen, with a maximum pressure between 30 bar and 350 bar.

The second tank 7 furthermore comprises a liquid inlet and a liquid outlet 15, which in the variant shown are designed as one element. In principle, a liquid inlet with an inlet valve, and a separate liquid outlet with an outlet valve, may also be provided. The liquid inlet and/or liquid outlet 15 is arranged in a vertically lower region of the second tank 7. Advantageously, the gas inlet and/or gas outlet 13 is arranged vertically above the liquid inlet and/or a liquid outlet 15. In FIG. 1, the gas, such as hydrogen, stored in the second tank 7 is designated with reference sign 25, and the liquid, such as water, stored in the second tank 7 is designated with reference sign 24. The gas stored in the first tank 6 is also designated with reference sign 25.

The liquid outlet 15 is connected to a flow channel 20 which comprises a valve 19 and is fluidly connected to the internal combustion engine 3. The liquid 24 may be selectively injected into the combustion chamber of the internal combustion engine 3 to reduce or eliminate knocking during combustion. The pressure for the water injection may be controlled by means of the gas 25 stored in the second tank 7, and made available such that the water is supplied with a pressure above an established minimum or desired pressure.

Furthermore, gaseous fuel, for example hydrogen, is supplied to the internal combustion engine 3 via a flow channel 21, which fluidly connects the second tank 7 to the internal combustion engine 3 and may include a valve 14. The gaseous fuel is supplied to the internal combustion engine 3 with a pressure within a desired pressure range, for example with an operating pressure between 10 bar and 30 bar.

The internal combustion engine 3 is connected to an exhaust gas line 23 in which the exhaust gas is discharged. The exhaust gas line 23 comprises a condenser 4 in which condensation water is extracted from the exhaust gas. The water collected by means of the condenser 4 is supplied to the fluid inlet 15 of the second tank 7 via a flow channel 26 which preferably comprises a valve 17. For this, in the variant shown, a pump, such as a water pump 16, is arranged between the condenser 4 and the fluid inlet 15. In the variant shown, the pump 16 is arranged downstream of the valve 17.

The engine arrangement 1 shown in FIG. 1 is furthermore fluidly connected to a condenser 5 which can be connected to an air conditioning system. A flow channel 22 with a valve 18 is arranged between the condenser 5 and the fluid inlet 15 of the second tank 7. By means of the flow channel 22, condensation water collected in the condenser 5 is supplied to the second tank 7. The flow channel 22 is connected to the liquid pump 16.

The system illustrated in FIG. 1 may include an electronic control module, controller, and or processor 40 that may be programmed to receive inputs from various sensors and be programmed to control various actuators to control operation of the system. Two or more electronic modules, controllers, and/or processors 40 may communicate via one or more vehicle networks. The vehicle network may include a plurality of channels for communication. One channel of the vehicle network may be a serial bus such as a Controller Area Network (CAN). One of the channels of the vehicle network may include an Ethernet network defined by Institute of Electrical and Electronics Engineers (IEEE) 802 family of standards. Additional channels of the vehicle network may include discrete connections between modules or controllers and associated actuators and sensors and may include power signals from a vehicle battery. Different signals may be transferred over different channels of the vehicle network. For example, video signals may be transferred over a high-speed channel (e.g., Ethernet) while control signals may be transferred over CAN or dedicated connections. The vehicle network may include any hardware and software components that aid in transferring signals and data between modules. The vehicle network is not shown in FIG. 1 but it may be implied that the vehicle network may connect to any electronic module, controller, or processor that is present in a vehicle system. A vehicle system controller (40) may coordinate the operation of the various components including other modules, controllers, and processors. As referred to in this disclosure, a controller or processor may refer to one or more controllers, processors, or modules that may perform distributed processing of a particular function or task. The controllers, processors, or modules may be in communication with one or more other controllers, processors, and/or modules to coordinate tasks or functions. However, the simplified description of various tasks or functions (or portions thereof) described in this disclosure may be performed by different controllers, processors, and/or modules that do not communicate or coordinate with one another as understood by those of ordinary skill in the art.

In particular, controller 40 may be programed to control the operation of one or more valves 9, 11, 14, 17, 18, and 19 to control the flow of pressurized gaseous fuel from first fuel tank 6 to second fuel tank 7 and to internal combustion engine 3. Similarly, controller 40 may be programmed to control the operation of one or more valves to control the flow of an incombustible liquid 24 from condenser 4 into second fuel tank 7, as well as controlling injection of the incombustible fluid 24 into internal combustion engine 3 to reduce or eliminate engine knock, for example. Controller 40 may also control operation of internal combustion engine 3, turbine 10, and pump 16. In various configurations, controller 40 is programmed to control the flow of pressurized gaseous fuel from first tank 6 into second tank 7 to maintain pressure within second tank 7 above a corresponding minimum threshold. Similarly, controller 40 may be programmed to control the flow of incombustible liquid from exhaust flow condenser 4 and/or air conditioning condenser 5 into second tank 7 to maintain pressure within second tank 7 above the corresponding minimum threshold suitable for injection of the liquid 24 and/or gaseous fuel 25 into internal combustion engine 3. Flow control may be provided by controlling one or more valves 9, 11, 14, 17, 18, 19, pump 16, turbine 10 or various other components not specifically illustrated.

Figure 2:
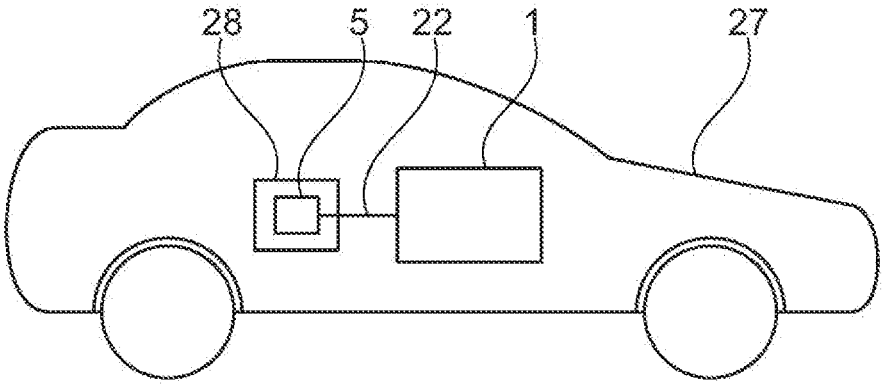
FIG. 2 shows schematically a representative vehicle according to the disclosure.

FIG. 2 shows schematically a representative vehicle configuration according to the disclosure, for example a motor vehicle 27. The motor vehicle 27 comprises an engine arrangement 1 as illustrated and described with reference to FIG. 1, and an air conditioning system 28 with a condenser 5. As shown in FIG. 1, the condenser 5 is fluidly connected to the second tank 7 of the engine arrangement 1. Instead of or in addition to the air conditioning system 28, the vehicle 27 may also comprise other or further elements which produce condensation water during operation. These elements, like the air conditioning system 28 shown, may be fluidly connected to the engine arrangement 1 so that the condensation water can be supplied to the second tank 7.

Figure 3:
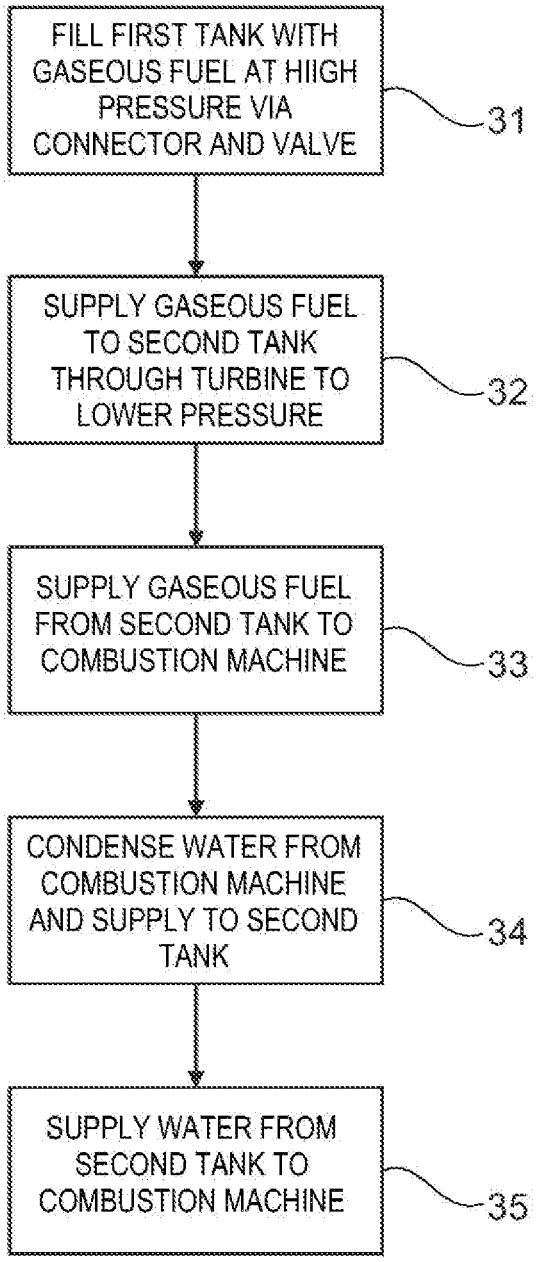
FIG. 3 shows schematically, in the form of a flow diagram, operation of a system or method according to the disclosure.

Control logic or functions performed by or distributed among one or more controllers, modules, processors, etc. is generally represented in the diagram of FIG. 3. This illustration provides a representative control strategy, algorithm, and/or logic that may be implemented using one or more processing strategies such as event-driven, interrupt-driven, multi-tasking, multi-threading, and the like. As such, various steps or functions illustrated may be performed in the sequence illustrated, in another sequence, in parallel, or in some cases omitted. Although not always explicitly illustrated, one of ordinary skill in the art will recognize that one or more of the illustrated steps or functions may be repeatedly performed individually and/or in combination. Similarly, the order of processing is not necessarily required to achieve the features and advantages of the claimed subject matter as described herein, but is provided for ease of illustration and description. The control logic may be implemented primarily in software executed by a microprocessor-based vehicle, engine, and/or powertrain controllers, generally represented by controller 40 of FIG. 1. Of course, the control logic may be implemented in software, hardware, or a combination of software and hardware in one or more controllers depending upon the particular application. When implemented in software, the control logic may be provided in one or more non-transitory computer-readable storage devices or media having stored data representing code or instructions executed by a computer to control the vehicle or its subsystems. The computer-readable storage devices or media may include one or more of a number of known physical devices which utilize solid state, electric, magnetic, and/or optical storage to keep executable instructions and associated calibration information, operating variables, and the like.

FIG. 3 shows schematically, in the form of a flow diagram, a controller implemented method according to the disclosure for operating a gas tank arrangement 2 and an engine arrangement 1. In a first step 31, the first tank 6 is filled with a gaseous fuel, e.g. hydrogen, via the filler connector 12 and the valve 11.

In a next step 32, gaseous fuel 25 is supplied to the second tank 7 by means of the first tank 6, i.e. from the first tank 6. Here, the second tank 7 is may be filled with gaseous fuel, e.g. hydrogen, with a pressure of at least 10 bar, for example, such as with a pressure between 30 bar and 350 bar. The second tank 7 is filled by means of the flow channel 8 and valve 9 via the gas inlet 13. Here, the pressure difference between the first tank 6 and the second tank 7 is advantageously used to obtain energy by means of the gas turbine 10.

In a third step 33, gaseous fuel is supplied from the second tank 7 to a combustion machine, for example an internal combustion engine 3 operated with hydrogen. The fuel, e.g. hydrogen, is supplied to the combustion machine with an established operating pressure within an established pressure range, e.g. with a pressure between 10 bar and 3 bar.

In step 34, liquid, e.g. water, which is recovered at least partially during operation of the combustion machine 3, for example by condensation, is conducted to the second tank 7. As FIG. 1 shows, water vapor may be condensed in the condenser 4 before moving through the flow channel 26 via operation of the pump 16. In addition, liquid, e.g. condensation water, may be supplied to the second tank 7 from further components, e.g. a condenser of an air conditioning system 5, as shown in FIG. 1.

In a next step 35, liquid is supplied from the second tank 7 to the combustion machine 3. The gaseous fuel 25 present in the second tank 7 may be used to pressurize the liquid 24 also present in the tank. The pressure may be controlled to a desired level that may be above an associated minimum pressure necessary for injection of the liquid into the combustion machine 3. Injection of water from the second tank 7 to the combustion machine 3 may be used to control the combustion process to reduce knock, for example.

The processes, methods, or algorithms disclosed herein can be deliverable to/implemented by a processing device, controller, or computer, which can include any existing programmable electronic control unit or dedicated electronic control unit. Similarly, the processes, methods, or algorithms can be stored as data and instructions executable by a controller or computer in many forms including, but not limited to, information stored on various types of non-transitory storage media including information permanently stored on non-writable storage media such as ROM devices and information alterably stored on writeable storage media such as optical, magnetic, or solid state media. The processes, methods, or algorithms can also be implemented in a software executable object. Alternatively, the processes, methods, or algorithms can be embodied in whole or in part using suitable hardware components, such as Application Specific Integrated Circuits (ASICs), Field-Programmable Gate Arrays (FPGAs), state machines, controllers or other hardware components or devices, or a combination of hardware, software, and firmware components While representative embodiments are described above, it is not intended that these embodiments describe all possible forms of the claimed subject matter. The words used in the specification are words of description rather than limitation, and it is understood that various changes may be made without departing from the spirit and scope of the claimed subject matter. Additionally, the features of various implementing embodiments may be combined to form further embodiments that may not be specifically illustrated or described.

What is claimed is:

1. A vehicle system comprising:

a first tank configured to contain compressed gaseous fuel;

a second tank fluidly couplable to the first tank and an internal combustion engine, the second tank configured to store gaseous fuel from the first tank in a communal cavity with a non-combustible liquid, and to selectively deliver the gaseous fuel via a first outlet, and the non-combustible liquid via a second outlet, to the internal combustion engine; and a turbine disposed within a fluid path between the first tank and the second tank.

2. The vehicle system of claim 1 further comprising a condenser having an inlet coupled to an exhaust path of the internal combustion engine and an outlet coupled to the second tank.

3. The vehicle system of claim 2 further comprising a pump disposed in a fluid path between the condenser and the second tank.

4. The vehicle system of claim 3 further comprising an air conditioning condenser fluidly coupled to the pump.

5. The vehicle system of claim 1 wherein the first tank is configured for a maximum internal pressure between 350 bar and 750 bar, and the second tank is configured for a maximum internal pressure between 30 bar and 350 bar.

6. The vehicle system of claim 1 wherein the second tank is configured to deliver gaseous fuel with a pressure between 10 bar and 30 bar to the internal combustion engine.

7. The vehicle system of claim 1 wherein the second tank comprises a gas inlet with an associated gas inlet valve, a gas outlet with an associated gas outlet valve, a liquid inlet with an associated liquid inlet valve, and a liquid outlet with an associated liquid outlet valve.

8. The vehicle system of claim 1 further comprising a controller programmed to control a valve disposed between the first tank and the second tank to pressurize the second tank using the compressed gaseous fuel from the first tank to a pressure above the higher of a minimum fuel injection pressure and a minimum liquid injection pressure for the internal combustion engine.

9. A method for controlling a vehicle having in internal combustion engine, the method comprising, by a controller:

controlling flow of pressurized gaseous fuel from a first tank to a turbine to drive the turbine, and from an outlet of the turbine to at least one of a second tank and the internal combustion engine, the second tank containing gaseous fuel and an incombustible liquid within a common cavity without a physical barrier therebetween;

supplying the incombustible liquid from an exhaust of the internal combustion engine to the second tank; and controlling injection of the gaseous fuel and the incombustible liquid from the second tank to the internal combustion engine.

10. The method according to claim 9 further comprising increasing the flow of pressurized gaseous fuel from the first tank when pressure within the second tank falls below a corresponding threshold.

11. The method according to claim 10 further comprising controlling a pump to supply the incombustible liquid from the exhaust to the second tank.

12. The method according to claim 11 wherein the pump is controlled in response to pressure within the second tank.

13. The method according to claim 9 further comprising condensing the incombustible liquid from the exhaust of the internal combustion engine.

14. A vehicle comprising:

an internal combustion engine;

a first fuel tank configured to contain pressurized gaseous fuel;

a second fuel tank fluidly coupled to the first fuel tank and configured to contain the gaseous fuel and a non-combustible liquid within a communal cavity without a physical separation barrier therebetween;

a turbine disposed between an outlet of the first fuel tank and an inlet of the second fuel tank and configured to be driven by pressurized gaseous fuel exiting the first fuel tank;

a condenser coupled to an exhaust flow from the internal combustion engine and having an outlet coupled to an inlet of the second fuel tank; and a controller programmed to control flow of the pressurized gaseous fuel from the first fuel tank to at least one of the second fuel tank and the internal combustion engine, to control flow of the incombustible liquid from the condenser to an input of the second fuel tank, and to control flow of the incombustible liquid from an outlet of the second fuel tank to an inlet of the internal combustion engine.

15. The vehicle of claim 14 further comprising an air conditioning condenser, wherein an output of the air conditioning condenser is coupled to an input of the second fuel tank.

16. The vehicle of claim 14 further comprising a pump disposed between the condenser coupled to the exhaust flow and the inlet of the second fuel tank.

17. The vehicle of claim 16 wherein the controller is further programmed to control the pump to pump the incombustible liquid into the second fuel tank to maintain pressure within the second fuel tank above an associated minimum pressure.

18. The vehicle of claim 17 wherein the controller is further programmed to control the flow of the pressurized gaseous fuel from the first fuel tank to the second fuel tank to maintain pressure within the second fuel tank above the associated minimum pressure.

* * * * *